United States Patent [19]

Ernst

[11] 4,296,656

[45] Oct. 27, 1981

[54] DRIVER BIT ATTACHMENT

[75] Inventor: Richard J. Ernst, Palatine, Ill.

[73] Assignee: Illinois Tool Works Inc., Chicago, Ill.

[21] Appl. No.: 141,863

[22] Filed: Apr. 21, 1980

[51] Int. Cl.[3] ..... B25B 23/00

[52] U.S. Cl. ..... 81/429

[58] Field of Search ..... 81/429, 54

[56] References Cited

U.S. PATENT DOCUMENTS

| | | | |
|---|---|---|---|
| 2,235,374 | 3/1941 | Kellogg | 81/429 |
| 3,454,059 | 7/1969 | Sindelar . | |
| 3,965,510 | 6/1976 | Ernst . | |
| 4,076,443 | 2/1978 | Halpern . | |
| 4,107,800 | 8/1978 | Jorgensen | 81/429 |

*Primary Examiner*—James L. Jones, Jr.
*Attorney, Agent, or Firm*—Thomas W. Buckman; Richard K. Thomson

[57] ABSTRACT

A driver bit attachment for a power tool for preventing over-torquing of the fastener. A driver bit is received in a first bore and a second larger bore of a cylindrical attachment body. A projection permits attachment to a drill or screw gun. The projection has a tapped recess extending axially therein which receives a set screw. The end of the set screw engages the trailing end of the driver bit to position it within the two bores and, thereby, determines the point at which the fastener will disengage itself from drive by pulling itself out of contact with the driver bit.

5 Claims, 3 Drawing Figures

DRIVER BIT ATTACHMENT

SUMMARY OF THE INVENTION

Various attempts have been made at providing a drive means which will drive but not over torque threaded fasteners. Such means include slip clutches, disengaging head gripping devices and the like. The present invention provides a simple adapter that can be chucked into a standard drill or into a screw gun to permit fasteners to be rotatively driven but not overdriven.

The present invention comprises an attachment which has a cylindrical body with a projection at one end. The projection can take the form of a hex which can be received in a screwgun adapter or in the chuck of an ordinary drill. The cylindrical body has first and second coaxial bores through which a driver bit extends. The bit is retained in the first (or the smaller) of the two bores by a set screw or the like. A second set screw is threadingly engaged in a threaded bore in the projection and engages the trailing end of the driver bit. By loosening the securing set screw first, the position of the driver bit within the first and second bores can be adjusted using the second screw. This permits the point at which the driver disengages the fastener head to be changed for various head styles, types of receiving material, style of driver bit, etc.

Further features, advantages and objects of the present invention will be better understood by reading the following detailed description in conjunction with the accompanying drawing.

DETAILED DESCRIPTION

Figure 1:
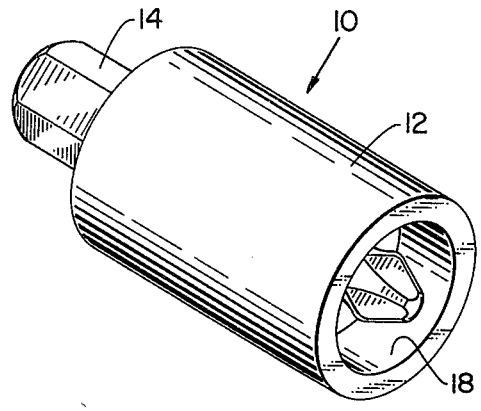
FIG. 1 is a perspective view of one embodiment of the attachment of the present invention.
Figure 2:
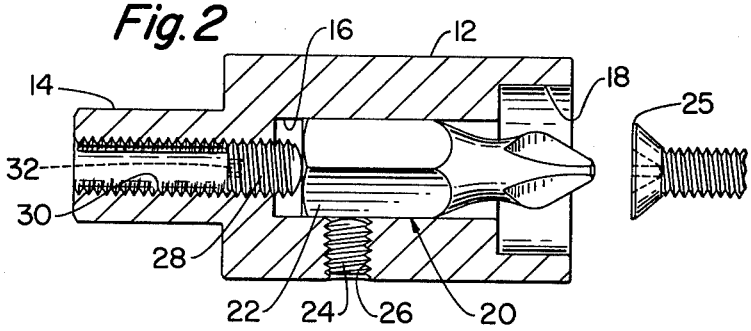
FIG. 2 is a partial cross-sectional view of the attachment of FIG. 1.

The driver bit attachment of the present invention is shown generally at 10. Attachment 10 has a generally cylindrical body portion 12 with projection 14 extending from one end. The cylindrical body 12 has a first bore 16 and a second bore 18 with a larger average or mean diameter than said first bore, the two bores extending coaxially therein. Bore 16 preferably has a polygonal (specifically, hexagonal, as shown) configuration for better driving engagement with a similarly shaped polygonal portion 22 on driver bit 20. Set screw 24 is threadingly engaged in tapped hole 26 and frictionally engages one of the planar sides of the polygonal portion 22 to retain the bit in the cylindrical body 12.

The second bore 18 has a generally cylindrical configuration with a mean diameter which is larger than the largest width dimension of a fastener head 25 with which the attachment is to be used. The depth of bore 18 is, similarly approximately equal to the height of the largest fastener head with which the attachment will be used. This dimensioning of the recess permits the fastener to drive itself out of engagement with driver bit 20 and prevent over torquing which could damage the surface of the parent material or break off the head, depending on whether the material in question is drywall or concrete. In this respect, the attachment is similar in function to the nosepiece disclosed and claimed in applicant's prior U.S. Pat. No. 3,965,510.

Unlike the standard hex-head fasteners with which the tool of the above noted patent is intended for use, internal drive recessed heads take many forms including pan head, flat head and bugle head, for example. Each of these head styles will need to be driven to a different depth in order to be considered fully seated. For this reason, the attachment 10 is provided with a depth of drive adjustment. This adjustment takes the form of a second set screw 28 threadingly engaged in tapped hole 30. As is conventional, the set screw has a hex recess 32 which permits adjustment from outside the attachment body by use of an allen wrench or the like. Adjustment can also be made for type of material (wallboard or paneling) being fastened or fastened to.

Figure 3:
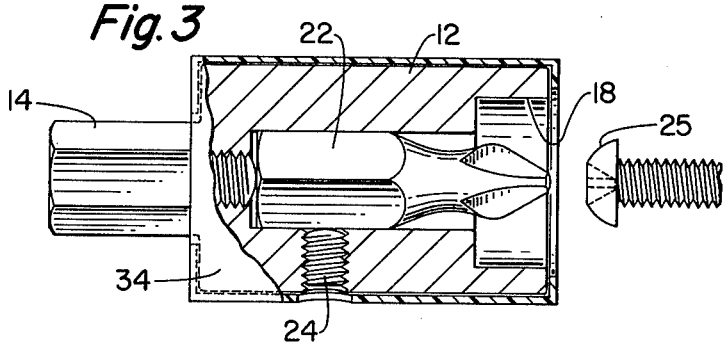
FIG. 3 is a partial cross-sectional view of an alternate configuration of the attachment of the present invention.

The embodiment shown in FIG. 3 includes a slip collar 34. This outer sleeve or collar 34 is generally a plastic material which will slide relative to the body 12 and which is non-fixedly coupled thereto. This collar is particularly useful in drywall applications, or the like, in preventing the tip of the attachment, which can be turning at a high rate of speed, from contacting and marring the surface of the material. This slip collar 34 also permits the workman to grasp and guide the tool in the same manner as is permitted by the mandrel disclosed in U.S. Pat. No. 4,107,800.

A very simple, economical attachment has been disclosed which can be inserted in a drill or screw gun for safely driving fasteners. It is, of course, understood that the driver bit can be an internal as well as external type drive member. Further, the bit 20 could be removed and the attachment used to support and drive a drill bit inserted therein and held by set screw 24 or the polygonal bore 16 could directly be used to drive hex headed screws as in the aforenoted U.S. Pat. No. 3,965,510. Also, it will be appreciated that the driver bit can be adjusted more forwardly to permit removal of the fasteners. Various changes, modifications, or alternatives will become obvious to the person of ordinary skill in the art in view of the foregoing specification. Accordingly, it is intended that all such changes, modifications and alternatives as come within the scope of the appended claims be considered as part of the present invention.

I claim:

1. An attachment for a power tool to permit driving of threaded fasteners said attachment comprising a generally cylindrical body; projection means extending from one end of said body, said projection means being adapted for connection to said power tool to receive rotational torque therefrom; a first longitudinal bore extending axially within said body; a driver bit having a portion which is received within said first bore; securing means within said first bore for retaining the driver bit therein; a second bore which has a larger mean diameter than said first bore, said second bore extending from said first bore to the end opposite the end having the projection, said second bore having an axial length approximately equal to the height of the fastener head with which the adaptor is to be used and a mean diameter larger than the maximum width dimension of the fastener head, a portion of said driver bit being received therein; a set screw threadingly engaged in a tapped hole in the the projecting means and extending into said first bore from said projection means end to position the driver bit within the first and second bores so that the point of disengagement of the driver bit from the fastener head may be varied in order to prevent over torquing of the fastener.

2. The attachment of claim 1 wherein said set screw may be adjusted from the exterior of the attachment body.

3. The attachment of claim 1 wherein the driver bit is of the type to engage an internal drive recess.

4. The attachment of claim 1 wherein the first bore and the portion of the driver bit received therein have a mating polygonal configuration.

5. The attachment of claim 1 wherein an outer sleeve is rotatably mounted to the exterior of the cylindrical body portion.

* * * * *